US008736640B2

(12) United States Patent
Lee

(10) Patent No.: US 8,736,640 B2
(45) Date of Patent: May 27, 2014

(54) LIQUID CRYSTAL DISPLAY APPARATUS AND METHOD FOR DRIVING THE SAME

(75) Inventor: Dong-Hwan Lee, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 304 days.

(21) Appl. No.: 13/311,957

(22) Filed: Dec. 6, 2011

(65) Prior Publication Data

US 2012/0169784 A1 Jul. 5, 2012

(30) Foreign Application Priority Data

Dec. 29, 2010 (KR) ..... 10-2010-0138039

(51) Int. Cl.
*G09G 5/10* (2006.01)
*G09G 3/36* (2006.01)

(52) U.S. Cl.
USPC ..... 345/690; 345/87

(58) Field of Classification Search
None
See application file for complete search history.

(56) References Cited

U.S. PATENT DOCUMENTS

| | | | | |
|---|---|---|---|---|
| 2006/0152444 | A1* | 7/2006 | Park | 345/63 |
| 2006/0267880 | A1* | 11/2006 | Jeon | 345/75.2 |
| 2008/0204439 | A1* | 8/2008 | Morita | 345/209 |
| 2010/0085387 | A1* | 4/2010 | Kim et al. | 345/690 |
| 2013/0057568 | A1* | 3/2013 | Liao et al. | 345/589 |
| 2013/0201223 | A1* | 8/2013 | Li et al. | 345/690 |

FOREIGN PATENT DOCUMENTS

| | | | |
|---|---|---|---|
| KR | 10-2004-0037295 | A | 5/2004 |
| KR | 10-2007-0062836 | A | 6/2007 |
| KR | 10-2008-0067194 | A | 7/2008 |
| KR | 10-2010-0058757 | A | 6/2010 |

* cited by examiner

*Primary Examiner* — Sumati Lefkowitz
*Assistant Examiner* — Peijie Shen
(74) *Attorney, Agent, or Firm* — Lee & Morse, P.C.

(57) ABSTRACT

A method of driving a liquid crystal display (LCD) apparatus, the method including the operations of determining whether a grayscale value of an input image has a same value for at least two frames; if the grayscale value of the input image has the same value for at least two frames, correcting a display image by generating the display image by converting the grayscale value of the input image into an adjacent grayscale value; and displaying the display image.

18 Claims, 11 Drawing Sheets

| FRAME | 1 | 2 | 3 | 4 | 5 | 6 |
|---|---|---|---|---|---|---|
| INPUT IMAGE | 0 | 0 | 0 | 0 | 0 | 0 |
| DISPLAY IMAGE | 0 | 0 | 1 | 1 | 0 | 0 |

FIG. 9

| FRAME | POLARITY | INPUT IMAGE | EMBODIMENT 1 DISPLAY IMAGE | COMPARATIVE EXAMPLE 1 | | EMBODIMENT 1 | |
|---|---|---|---|---|---|---|---|
| | | | | DATA SIGNAL (V) | BRIGHTNESS | DATA SIGNAL (V) | BRIGHTNESS |
| 1 | + | 0 | 0 | 3.52 | 0.45 | 3.52 | 0.45 |
| 2 | − | 0 | 1 | 0.09 | 0.45 | 0.51 | 0.50 |
| 3 | + | 0 | 1 | 3.52 | 0.45 | 3.10 | 0.50 |
| 4 | − | 0 | 0 | 0.09 | 0.45 | 0.09 | 0.45 |
| 5 | + | 0 | 0 | 3.52 | 0.45 | 3.52 | 0.45 |
| 6 | − | 0 | 1 | 0.09 | 0.45 | 0.51 | 0.50 |
| 7 | + | 0 | 1 | 3.52 | 0.45 | 3.10 | 0.50 |
| 8 | − | 0 | 0 | 0.09 | 0.45 | 0.09 | 0.45 |
| 9 | + | 0 | 0 | 3.52 | 0.45 | 3.52 | 0.45 |
| 10 | − | 0 | 1 | 0.09 | 0.45 | 0.51 | 0.50 |

FIG. 10

| FRAME | 1 | 2 | 3 | 4 | 5 | 6 |
|---|---|---|---|---|---|---|
| INPUT IMAGE | 63 | 63 | 63 | 63 | 63 | 63 |
| DISPLAY IMAGE | 63 | 63 | 62 | 62 | 63 | 63 |

FIG. 11

| FRAME | POLARITY | INPUT IMAGE | EMBODIMENT 2 DISPLAY IMAGE | COMPARATIVE EXAMPLE 2 | | EMBODIMENT 2 | |
|---|---|---|---|---|---|---|---|
| | | | | DATA SIGNAL (V) | BRIGHTNESS | DATA SIGNAL (V) | BRIGHTNESS |
| 1 | + | 63 | 63 | 0.14 | 450.0 | 0.14 | 450.0 |
| 2 | − | 63 | 62 | 3.47 | 450.0 | 3.01 | 434.5 |
| 3 | + | 63 | 62 | 0.14 | 450.0 | 0.60 | 434.5 |
| 4 | − | 63 | 63 | 3.47 | 450.0 | 3.47 | 450.0 |
| 5 | + | 63 | 63 | 0.14 | 450.0 | 0.14 | 450.0 |
| 6 | − | 63 | 62 | 3.47 | 450.0 | 3.01 | 434.5 |
| 7 | + | 63 | 62 | 0.14 | 450.0 | 0.60 | 434.5 |
| 8 | − | 63 | 63 | 3.47 | 450.0 | 3.47 | 450.0 |
| 9 | + | 63 | 63 | 0.14 | 450.0 | 0.14 | 450.0 |
| 10 | − | 63 | 62 | 3.47 | 450.0 | 3.01 | 434.5 |

FIG. 13

| FRAME | 1 | 2 | 3 | 4 | 5 | 6 | 7 | 8 | 9 | 10 | 11 | 12 |
|---|---|---|---|---|---|---|---|---|---|---|---|---|
| INPUT IMAGE | 0 | 0 | 0 | 0 | 0 | 0 | 0 | 0 | 0 | 0 | 0 | 0 |
| DISPLAY IMAGE | 0 | 0 | 0 | 0 | 1 | 1 | 1 | 1 | 0 | 0 | 0 | 0 |

FIG. 15

| FRAME | 1 | 2 | 3 | 4 | 5 | 6 | 7 | 8 | 9 | 10 | 11 | 12 |
|---|---|---|---|---|---|---|---|---|---|---|---|---|
| INPUT IMAGE | 2 | 2 | 2 | 2 | 2 | 2 | 2 | 2 | 2 | 2 | 2 | 2 |
| DISPLAY IMAGE | 2 | 2 | 3 | 3 | 2 | 2 | 1 | 1 | 2 | 2 | 3 | 3 |

LIQUID CRYSTAL DISPLAY APPARATUS AND METHOD FOR DRIVING THE SAME

CROSS-REFERENCE TO RELATED PATENT APPLICATION

This application claims the benefit of Korean Patent Application No. 10-2010-0138039, filed on Dec. 29, 2010, in the Korean Intellectual Property Office, the disclosure of which is incorporated herein in its entirety by reference.

BACKGROUND

1. Field

Embodiments relates to a liquid crystal display (LCD) apparatus and a method of driving the same.

2. Description of the Related Art

In a liquid crystal display (LCD) apparatus, a data driving unit converts input data into a data signal. A scan driving unit adjusts the brightness of each pixel by controlling a scanning operation of each pixel, so that an image corresponding to the input data is displayed. The LCD apparatus adjusts the brightness of each pixel by changing orientation of liquid crystal molecules of a liquid crystal layer. Each pixel of the LCD apparatus includes a storage capacitor that stores a data signal level, and a liquid crystal layer of which an orientation of liquid crystal molecules is changed in response to the data signal level, thereby adjusting brightness. A common voltage may be applied to the liquid crystal layer and the storage capacitor.

SUMMARY

Embodiments may be directed to a liquid crystal display (LCD) apparatus and a method of driving the same.

According to an embodiment, a method of driving a liquid crystal display (LCD) apparatus may include the operations of determining whether a grayscale value of an input image has a same value for at least two frames; if the grayscale value of the input image has the same value during at least two frames, correcting a display image by generating the display image by converting the grayscale value of the input image into an adjacent grayscale value; and displaying the display image.

The method may further include, if the grayscale value of the input image does not have the same value for at least two frames, the operation of generating the display image so as to have the grayscale value of the input image.

The method may further include the operation of determining whether the grayscale value of the input image is in a high grayscale range or in a low grayscale range, and the operation of correcting the display image may be performed only when the grayscale value of the input image is in the high grayscale range or in the low grayscale range.

The operation of correcting the display image may include the operation of generating the display image whereby the display image alternately has the grayscale value and the adjacent grayscale value by units of two frames.

The operation of correcting the display image may include the operation of generating the display image whereby the display image alternately has the grayscale value and the adjacent grayscale value by units of four frames.

The operation of correcting the display image may include the operations of setting a grayscale value of the display image as the grayscale value of the input image; setting the grayscale value of the display image as an upper adjacent grayscale value of the input image; setting again the grayscale value of the display image as the grayscale value of the input image; and setting the grayscale value of the display image as a lower adjacent grayscale value of the input image.

The operation of correcting the display image may include the operations of setting a grayscale value of the display image as the grayscale value of the input image during n frames; setting the grayscale value of the display image as an upper adjacent grayscale value of the input image during n frames; setting again the grayscale value of the display image as the grayscale value of the input image during n frames; and setting the grayscale value of the display image as a lower adjacent grayscale value of the input image during n frames, wherein n is a natural number.

The LCD apparatus may be driven by using at least one of a frame inversion method, a line inversion method, and a dot inversion method.

According to another embodiment, a liquid crystal display (LCD) apparatus may include a comparison unit for determining whether a grayscale value of an input image has the same value during at least two frames; a data converting unit for generating a display image by converting the grayscale value of the input image into an adjacent grayscale value if the grayscale value of the input image has the same value during at least two frames; and a plurality of pixels for displaying the display image.

The data converting unit may generate the display image so as to have the grayscale value of the input image if the grayscale value of the input image does not have the same value during at least two frames.

The data converting unit may determine whether the grayscale value of the input image is in a high grayscale range or in a low grayscale range and, if the grayscale value of the input image is not in the high grayscale range or in the low grayscale range, the data converting unit may generate a display image having the grayscale value of the input image.

The data converting unit may generate the display image whereby the display image alternately may have the grayscale value and the adjacent grayscale value by units of two frames.

The data converting unit may generate the display image whereby the display image alternately may have the grayscale value and the adjacent grayscale value by units of four frames.

When the grayscale value of the input image has the same value for at least two frames, the data converting unit may generate the display image whereby the display image may sequentially have the grayscale value of the input image, an upper adjacent grayscale value of the input image, the grayscale value of the input image, and a lower adjacent grayscale value of the input image.

When the grayscale value of the input image has the same value for at least two frames, the data converting unit may generate the display image whereby the display image may sequentially have the grayscale value of the input image during n frames, an upper adjacent grayscale value of the input image during n frames, the grayscale value of the input image during n frames, and a lower adjacent grayscale value of the input image during n frames, wherein n is a natural number.

The LCD apparatus may be driven by using at least one of a frame inversion method, a line inversion method, and a dot inversion method.

The LCD apparatus may further include a scan driving unit for outputting a gate signal for selecting each pixel from among the plurality of pixels; and a data driving unit for receiving the display image, generating a data signal, and outputting the data signal to the plurality of pixels.

The LCD apparatus may further include an input image storage unit for storing the input image.

BRIEF DESCRIPTION OF THE DRAWINGS

The above and other features of present embodiments will become more apparent by describing in detail exemplary embodiments thereof with reference to the attached drawings in which:

FIG. 9 is a comparison table illustrating data signals and brightness levels according to an embodiment 1 and data signals and brightness levels according to a comparative example 1, when input images constantly have the same low grayscale value;

FIG. 10 is a diagram illustrating a driving method of the LCD apparatus when input images constantly have the same high grayscale value, according to an embodiment;

FIG. 11 is a comparison table illustrating data signals and brightness levels according to an embodiment 2 and data signals and brightness levels according to a comparative example 2, when input images constantly have the same high grayscale value;

FIG. 13 is a diagram illustrating a driving method of the LCD apparatus, according to another embodiment;

FIG. 15 illustrates a method of driving an LCD apparatus, according to another embodiment.

DETAILED DESCRIPTION

Example embodiments will now be described more fully hereinafter with reference to the accompanying drawings; however, they may be embodied in different forms and should not be construed as limited to the embodiments set forth herein.

Figure 1:
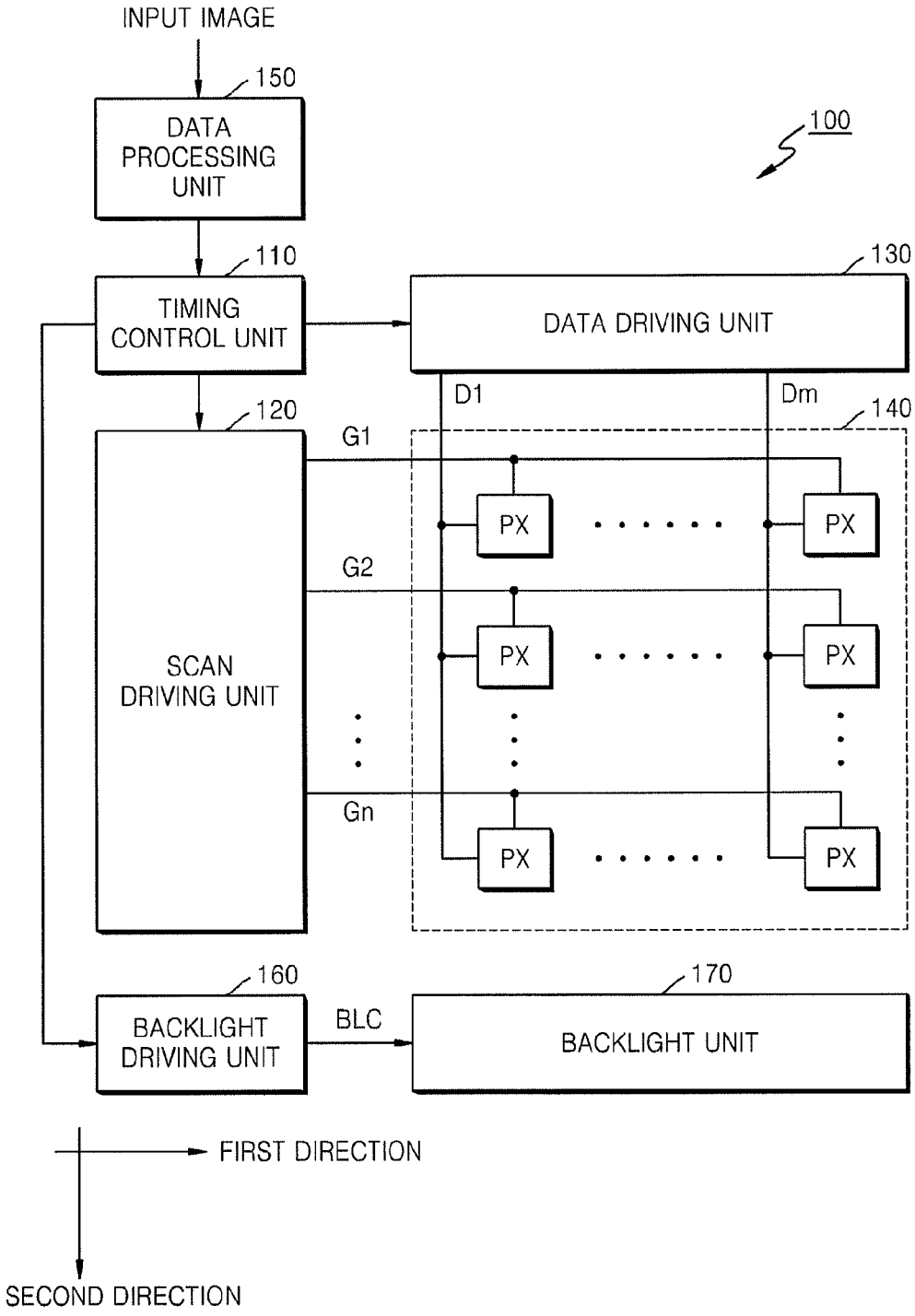
FIG. 1 illustrates a structure of a liquid crystal display (LCD) apparatus according to an embodiment.

FIG. 1 illustrates a structure of a liquid crystal display (LCD) apparatus 100 according to an embodiment.

The LCD apparatus 100 includes a timing control unit 110, a scan driving unit 120, a data driving unit 130, a pixel unit 140, a data processing unit 150, a backlight driving unit 160, and a backlight unit 170.

The timing control unit 110 receives a display image from the data processing unit 150, receives a data enable signal, a vertical synchronization signal, a horizontal synchronization signal, and a clock signal from an external graphic controller (not shown), and then generates an image data signal, a data driving control signal, and a gate driving control signal.

The timing control unit 110 receives input control signals including the horizontal synchronization signal, the clock signal, the data enable signal, etc., and then generates the data driving control signal. Here, the data driving control signal is used to control operations of the data driving unit 130, and may include a source shift clock signal, a source start pulse signal, a polarity control signal, a source output enable signal, etc. Also, the timing control unit 110 receives the vertical synchronization signal, the clock signal, etc., and then generates the gate driving control signal. The gate driving control signal is used to control an operation of the scan driving unit 120, and may include a gate start pulse signal, a gate output enable signal, etc.

The scan driving unit 120 generates gate signals sequentially having scan pulses according to a row order, in response to the gate driving control signal received from the timing control unit 110, and provides the gate signals to gate lines G1 through Gn. Here, the scan driving unit 120 determines a voltage level of each scan pulse according to a gate high voltage and a gate low voltage that are generated by and provided from a direct current-to-direct current (DC-DC) converter (not shown). The voltage level of each scan pulse may vary according to the type of switching device included in each pixel PX. In a case where the switching device is formed as an n-type transistor, a scan pulse has a gate high voltage during an active period of the scan pulse, and in a case where the switching device is formed as a p-type transistor, a scan pulse has a gate low voltage during an active period of the scan pulse.

The data driving unit 130 provides data signals to data lines D1 through Dm in response to the image data signal and the data driving control signal received from the timing control unit 110. In more detail, the data driving unit 130 performs sampling on the image data signal received from the timing control unit 110, latches the image data signal, and then converts the image data signal into an analog data signal by using a gamma voltage provided from a gamma voltage generation circuit (not shown), wherein the analog data signal may express a grayscale in pixels PX of the pixel unit 140.

The pixel unit 140 includes the pixels PX arranged near cross points between the data lines D1 through Dm and the gate lines G1 through Gn. Each pixel PX is connected to at least one data line Di and at least one gate line Gj. The gate lines G1 through Gn extend in a first direction and are arranged in parallel, and the data lines D1 through Dm extend in a second direction and are arranged in parallel. However, in another embodiment, the gate lines G1 through Gn may extend in a second direction and the data lines D1 through Dm may extend in a first direction. A structure of each pixel PX is described as follows with reference to FIG. 2.

Figure 2:
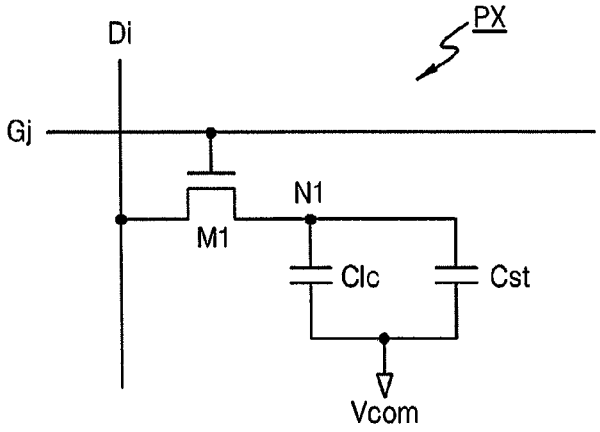
FIG. 2 is a circuit diagram of a structure of a pixel according to an embodiment.

FIG. 2 is a circuit diagram of a structure of a pixel PX according to an embodiment.

The pixel PX includes a switching transistor M1, a liquid crystal layer Clc, and a storage capacitor Cst. Here, the pixel PX represents a concept covering upper and lower substrates (in particular, a common electrode and a pixel electrode formed in the upper and lower substrates), and the liquid crystal layer Clc formed between the upper and lower substrates of an LCD panel. The switching transistor M1 includes a gate electrode connected to a gate line Gj, a first electrode connected to a data line Di, and a second electrode connected to a first node N1. The switching transistor M1 may be formed as a thin-film transistor (TFT). The first node N1 is electrically equivalent to the pixel electrode. The liquid crystal layer Clc is arranged between the first node N1 and the common electrode providing a common voltage Vcom. The liquid crystal layer Clc is equivalent to the pixel electrode and the common electrode, and liquid crystal molecules interposed between the pixel electrode and the common electrode. The storage capacitor Cst is connected between the first node N1 and the common electrode providing the common voltage Vcom.

When a scan pulse is input to the gate line Gj, the switching transistor M1 is turned on so that a data signal input via the data line Di is applied to the first node N1. Due to the data signal, a voltage level of the data signal is stored in the storage capacitor Cst. Orientation of the liquid crystal molecules of the liquid crystal layer Clc is changed according to a voltage of the first node N1, so that light transmittance of the liquid crystal molecules is changed accordingly.

The data processing unit 150 (refer to FIG. 1) receives an input image signal from the external graphic controller, compares a previous input image with a current input image, generates a display image by changing a grayscale value of the current input image into an adjacent grayscale value when the grayscale value of the current input image and the adjacent grayscale value of the previous input image are the same during at least two frames, and outputs the display image to the timing control unit 110. The number of frames in which the previous input image and the current input image are the same and at which the grayscale value of the input image is changed may vary.

The backlight unit 170 is disposed at a rear surface of the pixel unit 140, is lit by a backlight driving signal BLC provided from the backlight driving unit 160, and emits light to the pixels PX of the pixel unit 140. The backlight driving unit 160 generates the backlight driving signal BLC by a control of the timing control unit 110, outputs the backlight driving signal BLC to the backlight unit 170, and then controls emission of the backlight unit 170.

As described above in the one or more embodiments, when input images are the same during several frames, display images are generated by changing grayscale values of the input image into an adjacent grayscale value, so that it is possible to prevent the liquid crystal layer Clc from deteriorating and to prevent generation of an afterimage due to the deterioration of the liquid crystal layer Clc. When the one or more embodiments are applied to the LCD apparatus 100 that is a line inversion type, it is possible to minimize a DC component that is incurred when images having the same grayscale value are displayed during several frames.

Figure 3:
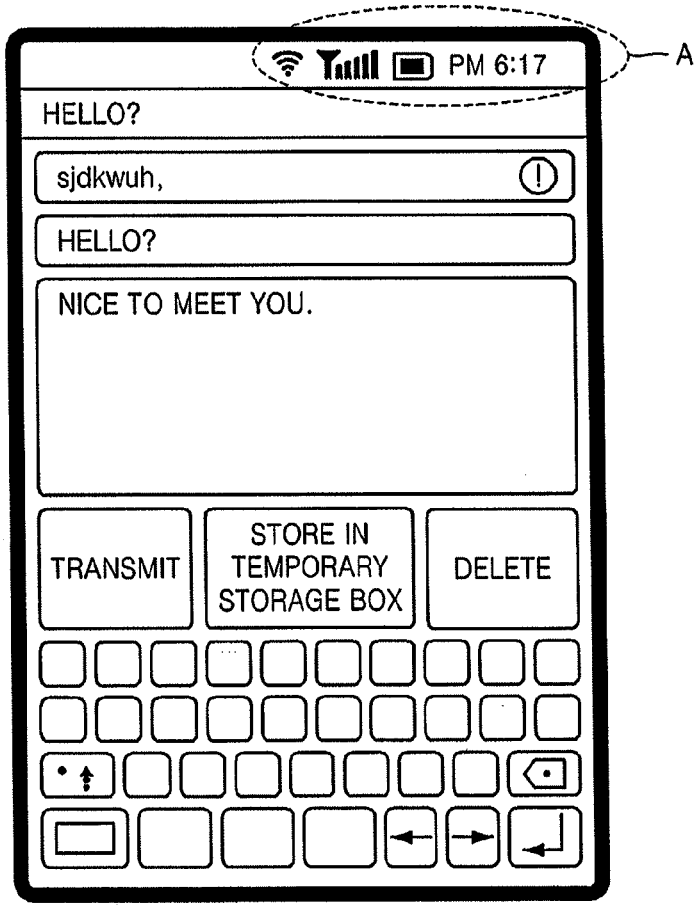
FIG. 3 illustrates a screen of a device using the LCD apparatus according to the embodiment.

FIG. 3 illustrates a screen of a device using the LCD apparatus 100 according to the embodiment.

The LCD apparatus 100 according to the one or more embodiments may be widely used in a large television (TV), a mobile phone, a digital camera, a small electronic device, an electronic display board, etc. However, when the LCD apparatus 100 is used, some pixels PX may display the same grayscale for a long time. For example, in a portion A of the screen of a mobile phone shown in FIG. 3, pixels PX of the portion A, which indicate a communication status, a battery status, a time, etc., display the same grayscale for a long time while the mobile phone is used. However, when the same grayscale is displayed for a long time, a DC component is incurred in the pixels PX, such that the liquid crystal layer Clc deteriorates and an afterimage is generated.

Figures 4, 5:
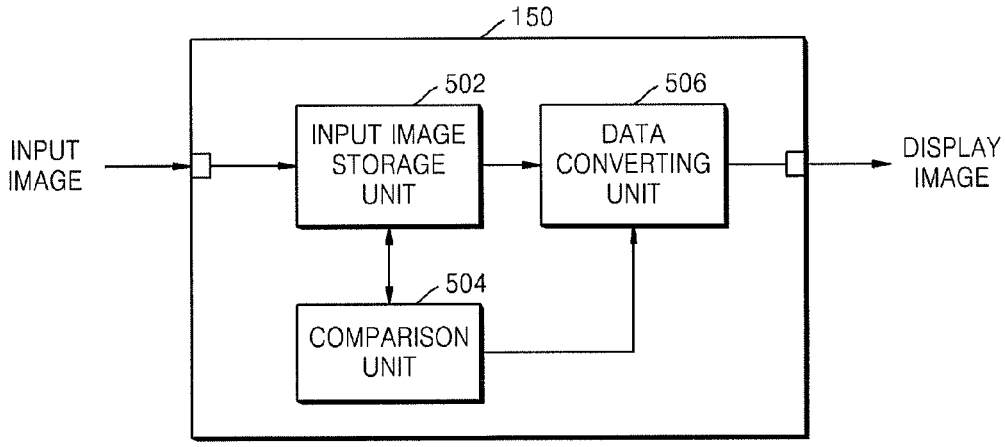
FIG. 4 is a diagram illustrating a driving method of the LCD apparatus, according to an embodiment.
FIG. 5 illustrates a structure of a data processing unit according to an embodiment.

FIG. 4 is a diagram illustrating a driving method of the LCD apparatus 100, according to an embodiment.

According to the present embodiment, when input images of the LCD apparatus 100 have the same grayscale during at least two frames, display images are generated by changing grayscale values of the input images into an adjacent grayscale value. Here, whether input images having the same grayscale value are input is determined by a unit of a pixel PX, and a process of converting an input image into a display image is also performed by the unit of a pixel PX. It is possible to vary the number of frames during which whether the same grayscale is continued is determined. Also, it is possible to vary the number of frames at which grayscale values of input images are changed. For example, when input images have the same grayscale value during three or more frames, as illustrated in FIG. 4, display images may be generated by changing grayscale values of the input images into an adjacent grayscale value by units of two frames. In the embodiment of FIG. 4, while input images constantly have a black grayscale, that is, a value of 0, display images are converted into an adjacent grayscale value by units of two frames.

FIG. 5 illustrates a structure of the data processing unit 150 according to an embodiment.

The data processing unit 150 receives an input image and then generates a display image. The data processing unit 150 may include an input image storage unit 502, a comparison unit 504, and a data converting unit 506.

The input image storage unit 502 receives and stores the input image. The input image storage unit 502 may be a frame memory that stores an input image by a unit of a frame. Various types of storage mediums including a random access memory (RAM), a flash memory, etc., may be used as the input image storage unit 502.

The comparison unit 504 compares a grayscale value of a current input image with a grayscale value of a previous input image, and outputs a comparison result to the data converting unit 506. The comparison between the current input image and the previous input image is performed by a unit of a pixel PX. In order to store the grayscale value of the previous input image, the comparison unit 504 may include a storage medium.

The data converting unit 506 receives the current input image from the input image storage unit 502, receives the comparison result from the comparison unit 504, and then converts the current input image into a display image. As a result of the comparison, when the current input image and the previous input image are the same, the data converting unit 506 generates a display image by converting the grayscale value of the current input image into an adjacent grayscale value by a unit of at least one frame, and when the current input image and the previous input image are different from each other, the data converting unit 506 generates a display image by maintaining the grayscale value of the current input image.

In an embodiment, the data converting unit 506 may convert grayscale values of input images into an adjacent grayscale value only when the input images maintain the same grayscale value during frames equal to or greater than a predetermined number. For this conversion, the data converting unit 506 may include a counter. Although grayscale values of input images are maintained at the same value during several frames, if the same grayscale value is maintained during frames less than a predetermined number and then a grayscale value of an input image is changed to another grayscale value, the data converting unit 506 generates a display image without converting the grayscale value of the input image into an adjacent grayscale value but maintaining the grayscale value of the input image. The data converting unit 506 may convert grayscale values of input images into an adjacent grayscale value only when the input images are maintained at the same grayscale value during frames equal to or greater than a predetermined number. For example, in a case where grayscale values of input images are converted into an adjacent grayscale value only when the input images have the same grayscale value during four or more frames, if input images have the same grayscale value during three frames and then have another grayscale value thereafter, grayscale values of the input images are converted into display images without a change, but if input images have the same grayscale value during five frames, a display image is generated by converting a grayscale value of a fifth frame into an adjacent grayscale value.

Figure 6:
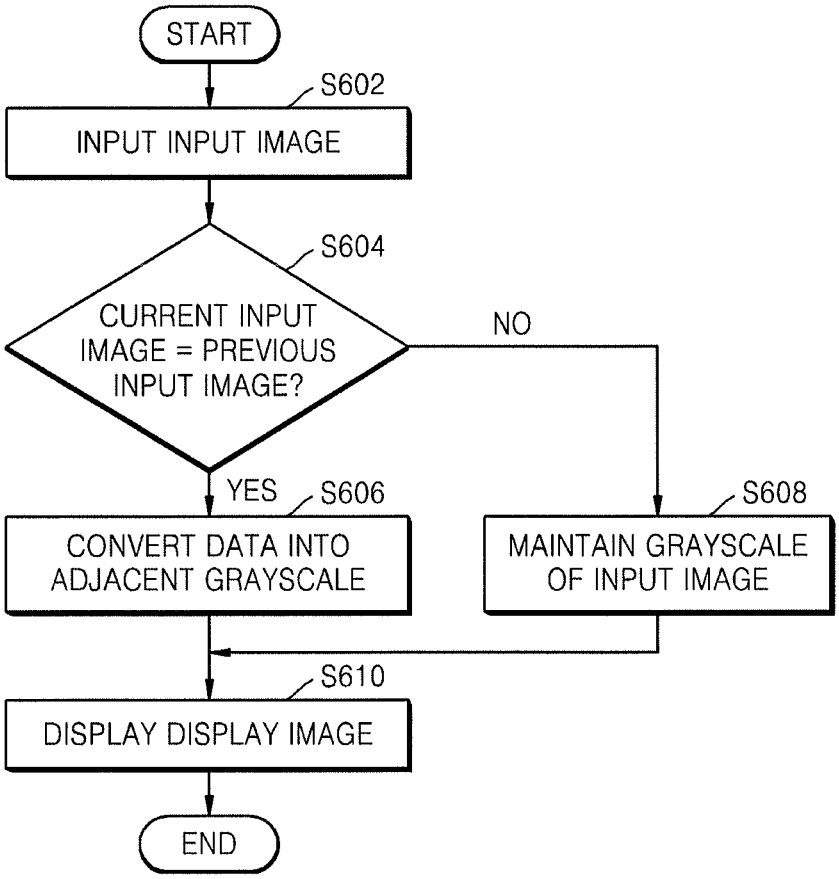
FIG. 6 is a flowchart of a method of driving an LCD apparatus, according to an embodiment.

FIG. 6 is a flowchart of a method of driving an LCD apparatus, according to an embodiment.

First, when a current input image is input (S602), it is determined whether a grayscale value of the current input image and a grayscale value of a previous input image are the same (S604). If the grayscale values of the current input image and the previous input image are the same, a display image is generated by converting the grayscale value of the current input image into an adjacent grayscale value (S606). Otherwise, if the grayscale values of the current input image and the previous input image are different, a display image is generated by maintaining the grayscale value of the current input image (S608). Next, the display image is input to the timing control unit 110 or the data driving unit 130 (S610).

Figure 7:
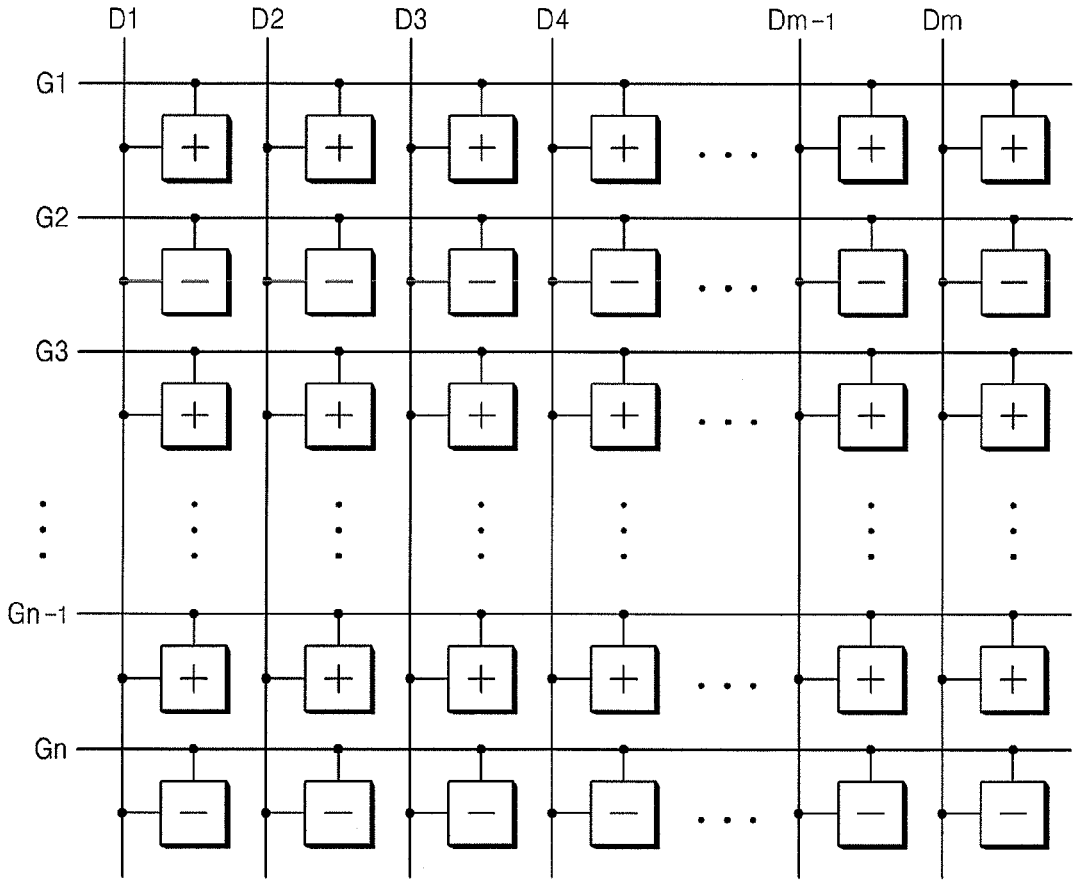
FIG. 7 is a diagram schematically illustrating a line inversion method, according to an embodiment.

Even when the one or more embodiments are applied to an inversion driving method by which a polarity of a voltage applied to the liquid crystal layer Clc for each frame is inverted, a DC component may be removed. FIG. 7 is a diagram describing a line inversion method, according to an embodiment.

Referring to FIG. 7, the LCD apparatus 100 may be driven by performing the line inversion method in which inversion is performed in a unit of a line. FIG. 7 illustrates a polarity of a voltage applied to the liquid crystal layer Clc during a frame. In a next frame, a voltage is applied in a manner that a positive polarity is inverted into a negative polarity and a negative polarity is inverted into a positive polarity.

The one or more embodiments may be applied to not only the line inversion method of FIG. 7 but also applied to a frame inversion method by which polarities of all pixels PX are equally inverted in a frame and to a dot inversion method by which polarities of all pixels PX are inverted according to a dot pattern.

Figure 8:
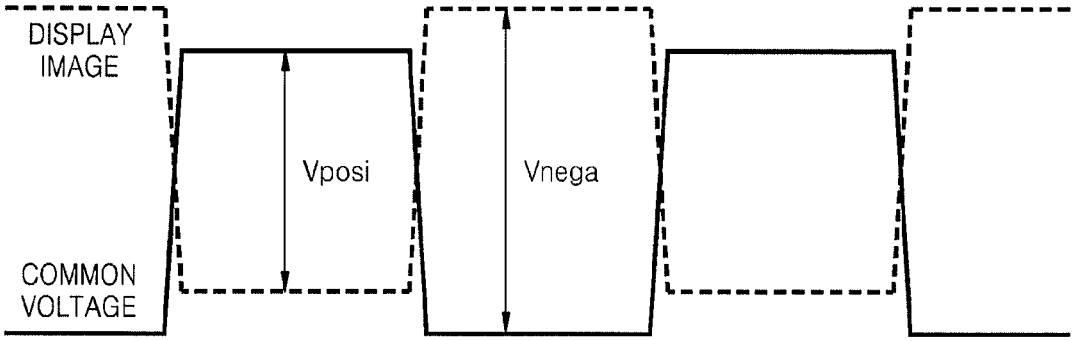
FIG. 8 illustrates levels of a data signal and a common voltage according to a polarity inversion method.

FIG. 8 illustrates levels of a data signal and a common voltage Vcom according to a polarity inversion method.

When the polarity inversion method, including the frame inversion method, the line inversion method, the dot inversion method, etc., is used, as illustrated in FIG. 8, the levels of the data signal and the common voltage Vcom are inverted so that a polarity of each pixel PX may be inverted. However, in the polarity inversion method, when polarities are inverted, a kick-back voltage, which is proportional to the gate-source capacitance of a switching transistor and a voltage of a gate electrode, may be generated. In order to compensate for the kick-back voltage, as illustrated in FIG. 8, a voltage difference Vposi between the data signal and the common voltage Vcom at a positive polarity may be different from a voltage difference Vnega between the data signal and the common voltage Vcom at a negative polarity. The kick-back voltage generated due to inversion of the polarities may be compensated for, so that a DC voltage may not be applied to the liquid crystal layer Clc.

However, the compensation for the kick-back voltage is performed in a predetermined target grayscale range, such that a DC voltage is still applied to the liquid crystal layer Clc in a grayscale range deviating from the predetermined target grayscale range. For example, in a case where the compensation for the kick-back voltage is performed in an intermediate grayscale range, the kick-back voltage is not compensated for in a high grayscale range reaching a white color or in a low grayscale range reaching a black color, such that a DC voltage is still applied to the liquid crystal layer Clc. Also, in a case where a voltage corresponding to a constant high grayscale or a voltage corresponding to a constant low grayscale is continually applied to the liquid crystal layer Clc, a DC voltage is also continually applied to the liquid crystal layer Clc such that an afterimage may be generated. As described above, according to the one or more embodiments, when input images having the same grayscale value are continually input, display images are generated by converting grayscale values of the input images into an adjacent grayscale value, so that an afterimage problem is solved. Also, this effect is maximized in a high grayscale range and a low grayscale range.

FIG. 9 is a comparison table illustrating data signals and brightness levels according to an embodiment 1 and data signals and brightness levels according to a comparative example 1, when input images constantly have the same low grayscale value. FIG. 9 illustrate a data signal and a brightness level of the LCD apparatus 100 of which a brightness is 450 nit, a contrast ratio is 1000:1, and grayscale is 64.

As illustrated in FIG. 9, in a case where a polarity is inverted by a unit of a frame and input images constantly have a grayscale value of 0, according to the embodiment 1, grayscale values of the input images are converted into an adjacent grayscale value by units of two frames and then the converted input images are output as display images. However, according to the comparative example 1, although a polarity is inverted by a unit of a frame, grayscale values of input images are output without a change.

In the comparative example 1, the grayscale values of the input images are output as display images without a change, so that the data signals have the same level by units of two frames and the brightness levels are the same, as illustrated in FIG. 9. Thus, a DC component incurred in a pixel PX is not compensated for and the liquid crystal layer Clc deteriorates such that an afterimage is generated.

On the other hand, in the embodiment 1, an adjacent grayscale value and the grayscale value of the input image are alternately output as grayscale values of the display images by units of two frames. Thus, as illustrated in FIG. 9, the data signals have different levels by units of two frames, so that a DC component applied to the liquid crystal layer Clc may be minimized. That is, referring to the data signals of FIG. 9, grayscale values are changed by units of two frames, so that first, third, fifth, seventh, and ninth frames having a positive polarity alternately have data signal levels of 3.52 V and 3.10V, and second, fourth, sixth, eighth, and tenth frames having a negative polarity alternately have data signal levels of 0.52 V and 0.09 V, thus, a DC component applied to the liquid crystal layer Clc may be minimized.

Also, according to the one or more embodiments, when grayscale values of input images are constantly the same, the grayscale values of the input images are converted into an adjacent grayscale value, so that an afterimage may be effectively removed while a user does not recognize a change in brightness. Actually, human eyes cannot recognize a change in brightness although two grayscales adjacent to each other at 30 Hz or a higher level are alternately output. If a grayscale value is converted into a random grayscale value, instead of an adjacent grayscale value, a user recognizes a change in a grayscale. The change may look like a flicker, so that an image quality deteriorates.

FIG. 10 is a diagram illustrating a driving method of the LCD apparatus 100 when input images constantly have the same high grayscale value, according to an embodiment. FIG. 11 is a comparison table illustrating data signals and brightness levels according to an embodiment 2 and data signals and brightness levels according to a comparative example 2, when input images constantly have the same high grayscale value. FIG. 11 illustrate a data signal and a brightness level of the LCD apparatus 100 of which a brightness is 450 nit, a contrast ratio is 1000:1, and grayscale is 64.

As illustrated in FIG. 10, in a case where the input images constantly have the same high grayscale value, according to the embodiment 2, an adjacent grayscale value and the grayscale value of the input image are alternately output as grayscale values of display images. That is, when the input images constantly have a white grayscale value of 63, the display images alternately have a grayscale value of 63 and a grayscale value of 62 by units of two frames.

According to the case of FIG. 10, the data signals and the brightness levels of FIG. 11 are achieved. As illustrated in FIG. 11, in a case where the input images constantly have a grayscale value of 63, according to the embodiment 2, grayscale values of the input images are converted into an adjacent grayscale value by units of two frames and then the converted input images are output as display images. However, according to the comparative example 2, although a polarity is inverted by a unit of a frame, grayscale values of input images are output without a change.

As described above with reference to FIG. 9, in the comparative example 2, a DC component generated in a pixel PX may not be compensated for, and an afterimage is generated due to deterioration of the liquid crystal layer Clc.

On the other hand, in the embodiment 2, an adjacent grayscale value and the grayscale value of the input image are alternately output as grayscale values of the display images by units of two frames, so that a DC component applied to the liquid crystal layer Clc may be minimized.

Figure 12:
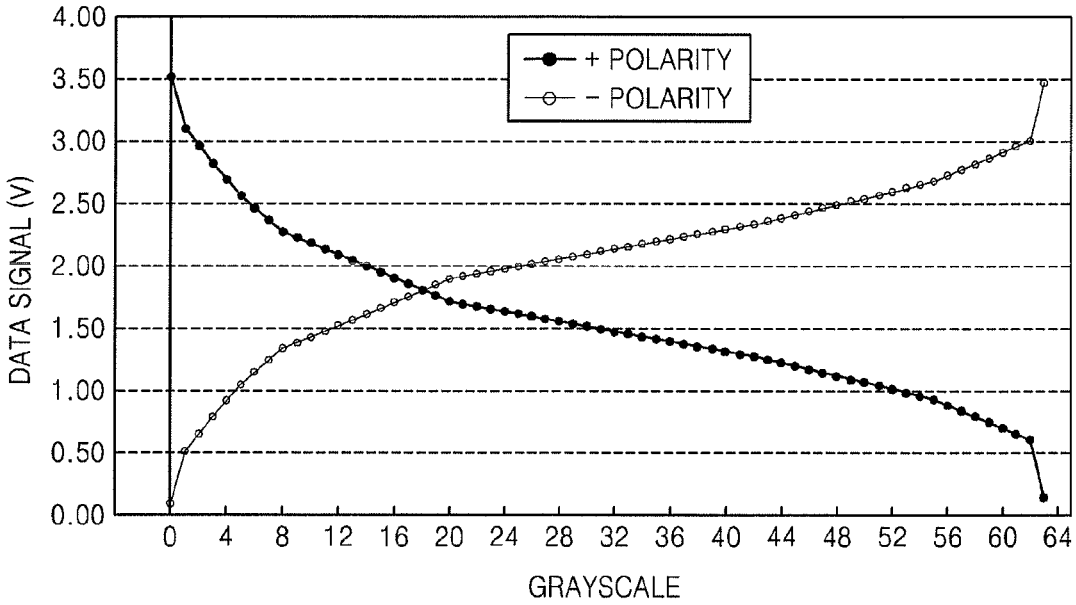
FIG. 12 is a graph showing levels of data signals according to grayscale values of the LCD apparatus.

FIG. 12 is a graph showing levels of data signals according to grayscale values of the LCD apparatus 100. FIG. 12 illustrates data signal levels at both of a positive polarity and a negative polarity.

As illustrated in FIG. 12, a data signal is generated by using a gamma voltage having undergone gamma correction. Thus, a voltage difference between data signals having adjacent grayscales is great according to grayscale ranges. In this regard, as illustrated in FIG. 12, a voltage difference between data signals having adjacent grayscales is greater in a low grayscale range reaching a black color and a high grayscale range reaching a white color, compared to an intermediate grayscale range. Thus, when a grayscale value of an input image is converted into an adjacent grayscale value, a change of a data signal level is greater in the low grayscale range reaching a black color and the high grayscale range reaching a white color, compared to the intermediate grayscale range, so that an effect of a DC component removal is great in the low grayscale range reaching a black color and the high grayscale range reaching a white color. According to some of embodiments, a grayscale value may corrected only in the high grayscale range and the low grayscale range in which a voltage difference between data signals having adjacent grayscales is great, so that an effect of an afterimage removal is maximized. The high grayscale range and the low grayscale range may be determined in advance or may be selected by a user. For example, the high grayscale range and the low grayscale range may be determined in advance as grayscale ranges in which compensation for a kick-back voltage is not performed.

FIG. 13 is a diagram illustrating a driving method of the LCD apparatus 100, according to another embodiment. According to the present embodiment, in a case where input images have the same grayscale value during several frames, as illustrated in FIG. 13, display images may be generated by converting grayscale values of input images into an adjacent grayscale value by units of four frames. As in the present embodiment, in a case where the grayscale values of the input images are converted into the adjacent grayscale value by units of four frames when the input images have the same grayscale value during several frames, power consumption by the data processing unit 150 may be reduced due to a decrease of the number of changes in data signal levels, compared to a case in which the grayscale values of the input images are converted into the adjacent grayscale value by units of two frames.

Figure 14:
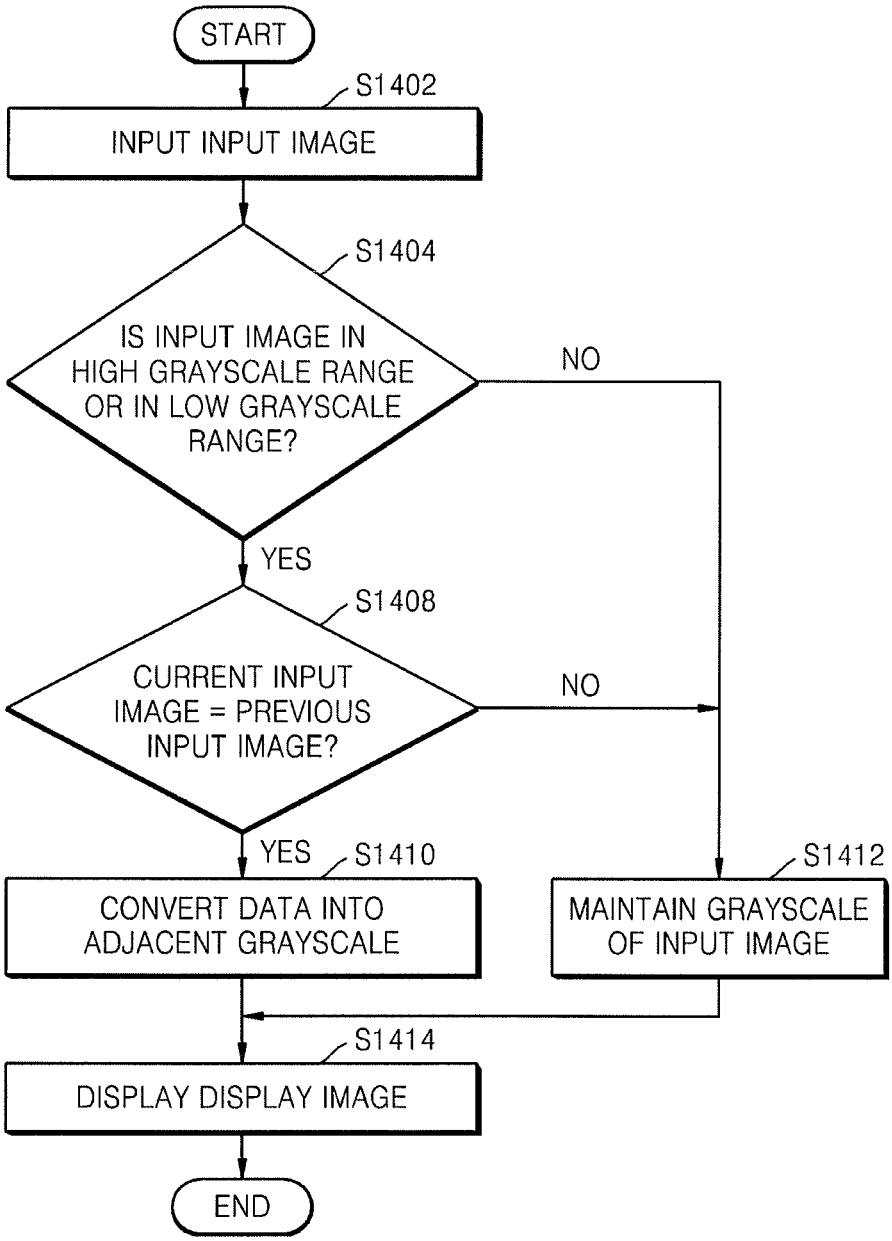
FIG. 14 is a diagram illustrating a driving method of the LCD apparatus, according to another embodiment.

FIG. 14 is a diagram illustrating a driving method of the LCD apparatus 100, according to another embodiment.

According to the present embodiment, when a current input image is input (operation S1402), it is determined whether a grayscale value of the current input image is in a high grayscale range or in a low grayscale range (operation S1404). If the grayscale value of the current input image is in the high grayscale range, it is determined whether the grayscale value of the current input image is the same as a grayscale value of a previous input image (operation S1408). If the grayscale value of the current input image is the same as the grayscale value of the previous input image, a grayscale value of a display image is corrected by using an adjacent grayscale value of the grayscale value of the current input image (operation S1410). Otherwise, if the grayscale value of the current input image is different from the grayscale value of the previous input image, the grayscale value of the current input image is determined as the grayscale value of the display image without a change (operation S1412).

If the current input image is not in the high grayscale range or in the low grayscale range (operation S1404), the grayscale value of the current input image is not corrected but is maintained so that a display image is generated (operation S1412). When the display image is generated, the display image is displayed (operation S1414).

According to the present embodiment, the grayscale value of the current input image is corrected only in the high grayscale range and in the low grayscale range in which a problem of an afterimage due to a DC component is severe, and the grayscale value of the current input image is not corrected in the rest of grayscale ranges, so that an effect is maximized and the correction of the grayscale value of the current input image is minimized.

FIG. 15 illustrates a method of driving an LCD apparatus, according to another embodiment.

Referring to the present embodiment, in a case where input images have the same grayscale value during at least two frames, grayscale values of display images are determined so as to alternately have a grayscale value of the input image, an upper adjacent grayscale value of the grayscale value, the grayscale value of the input image, and a lower adjacent grayscale value of the grayscale value. For example, as illustrated in FIG. 15, in a case where input images constantly have a grayscale value of 2, display images have a grayscale value of 2 that is the grayscale value of the input images during first and second frames, have a grayscale value of 3 that is an upper adjacent grayscale value during third and fourth frames, have the grayscale value of 2 that is the grayscale value of the input images during fifth and sixth frames, and have a grayscale value of 1 that is a lower adjacent grayscale value during seventh and eighth frames. In this manner, grayscale values of the display images may be repeatedly converted until a different grayscale value is input to an input image.

By way of summation and review, a liquid crystal layer may deteriorate when a voltage having the same polarity is continually applied thereto. In order to prevent the deterioration, a polarity of the liquid crystal layer is inverted by a unit of a frame. The polarity inversion may include a line inversion method, a dot inversion method, etc.

In a liquid crystal display (LCD) apparatus and a method of driving the same of the present embodiments it is possible to prevent generation of an afterimage due to deterioration of a liquid crystal layer when images having the same grayscale value are displayed during several frames.

According to present embodiments, levels of data signals are varied by greater amplitude, so that afterimage removal may be increased.

According to the one or more embodiments, it is possible to prevent generation of an afterimage due to deterioration of a liquid crystal layer when images having the same grayscale value are displayed during several frames. Thus, a display quality of an LCD apparatus is improved.

Exemplary embodiments have been disclosed herein, and although specific terms are employed, they are used and are to be interpreted in a generic and descriptive sense only and not for purpose of limitation.

What is claimed is:

1. A method of driving a liquid crystal display (LCD) apparatus, the method comprising:

determining whether a grayscale value of an input image has a same value for at least two frames;

in response to determining the grayscale value of the input image has the same value for at least two frames, correcting a display image to be displayed in the later one of the at least two frames by generating the display image by converting the grayscale value of the input image into an adjacent grayscale value; and displaying the display image.

2. The method as claimed in claim 1, further comprising, if the grayscale value of the input image does not have the same value for at least two frames, generating the display image so as to have the grayscale value of the input image.

3. The method as claimed in claim 1, further comprising determining whether the grayscale value of the input image is in a high grayscale range or in a low grayscale range, wherein the correcting of the display image is performed only when the grayscale value of the input image is in the high grayscale range or in the low grayscale range.

4. The method as claimed in claim 1, wherein the correcting of the display image includes generating the display image whereby the display image alternately has the grayscale value and the adjacent grayscale value by units of two frames.

5. The method as claimed in claim 1, wherein the correcting of the display image includes generating the display image whereby the display image alternately has the grayscale value and the adjacent grayscale value by units of four frames.

6. The method as claimed in claim 1, wherein the correcting of the display image includes:

setting a grayscale value of the display image as the grayscale value of the input image;

setting the grayscale value of the display image as an upper adjacent grayscale value of the input image;

setting again the grayscale value of the display image as the grayscale value of the input image; and setting the grayscale value of the display image as a lower adjacent grayscale value of the input image.

7. The method as claimed in claim 1, wherein the correcting of the display image includes:

setting a grayscale value of the display image as the grayscale value of the input image during n frames;

setting the grayscale value of the display image as an upper adjacent grayscale value of the input image during n frames;

setting again the grayscale value of the display image as the grayscale value of the input image during n frames; and setting the grayscale value of the display image as a lower adjacent grayscale value of the input image during n frames, wherein n is a natural number.

8. The method as claimed in claim 1, wherein the LCD apparatus is driven by using at least one of a frame inversion method, a line inversion method, and a dot inversion method.

9. A liquid crystal display (LCD) apparatus, comprising:

a comparison unit for determining whether a grayscale value of an input image has a same value for at least two frames;

a data converting unit for generating a display image to be displayed in the later one of the at least two frames by converting the grayscale value of the input image into an adjacent grayscale value in response to determining the grayscale value of the input image has the same value for at least two frames; and a plurality of pixels for displaying the display image.

10. The LCD apparatus as claimed in claim 9, wherein the data converting unit generates the display image so as to have the grayscale value of the input image if the grayscale value of the input image does not have the same value for at least two frames.

11. The LCD apparatus as claimed in claim 9, wherein the data converting unit determines whether the grayscale value of the input image is in a high grayscale range or in a low grayscale range and, if the grayscale value of the input image is not in the high grayscale range or in the low grayscale range, the data converting unit generates the display image having the grayscale value of the input image.

12. The LCD apparatus as claimed in claim 9, wherein the data converting unit generates the display image whereby the display image alternately has the grayscale value and the adjacent grayscale value by units of two frames.

13. The LCD apparatus as claimed in claim 9, wherein the data converting unit generates the display image whereby the display image alternately has the grayscale value and the adjacent grayscale value by units of four frames.

14. The LCD apparatus as claimed in claim 9, wherein, when the grayscale value of the input image has the same value for at least two frames, the data converting unit generates the display image whereby the display image sequentially has the grayscale value of the input image, an upper adjacent grayscale value of the input image, the grayscale value of the input image, and a lower adjacent grayscale value of the input image.

15. The LCD apparatus as claimed in claim 9, wherein, when the grayscale value of the input image has the same value for at least two frames, the data converting unit generates the display image whereby the display image sequentially has the grayscale value of the input image during n frames, an upper adjacent grayscale value of the input image during n frames, the grayscale value of the input image during n frames, and a lower adjacent grayscale value of the input image during n frames, wherein n is a natural number.

16. The LCD apparatus as claimed in claim 9, wherein the LCD apparatus is driven by using at least one of a frame inversion method, a line inversion method, and a dot inversion method.

17. The LCD apparatus as claimed in claim 9, further comprising:

a scan driving unit for outputting a gate signal for selecting each pixel from among the plurality of pixels; and a data driving unit for receiving the display image, generating a data signal, and outputting the data signal to the plurality of pixels.

18. The LCD apparatus as claimed in claim 9, further comprising an input image storage unit for storing the input image.

* * * * *